US005669458A

United States Patent [19]

Anders

[11] Patent Number: 5,669,458

[45] Date of Patent: Sep. 23, 1997

[54] ROTARY JAR

[76] Inventor: Edward O. Anders, 106 Saint Andrews Loop, Kerrville, Tex. 78028

[21] Appl. No.: 609,536

[22] Filed: Mar. 1, 1996

[51] Int. Cl.[6] ..... E21B 31/107

[52] U.S. Cl. ..... 175/299; 166/178; 175/304

[58] Field of Search ..... 166/178; 175/299, 175/302, 304, 305, 306

[56] References Cited

U.S. PATENT DOCUMENTS

| | | | |
|---|---|---|---|
| 2,096,135 | 10/1937 | Raymond | 175/303 |
| 2,585,318 | 2/1952 | Howard | 175/304 |
| 2,597,414 | 5/1952 | Waggener | 175/302 |
| 3,208,541 | 9/1965 | Lawrence | 175/299 |
| 3,233,690 | 2/1966 | Lawrence | 175/302 |
| 3,709,478 | 1/1973 | Kisling | 267/137 |
| 3,853,187 | 12/1974 | Sutliff et al. | 175/297 |
| 3,963,081 | 6/1976 | Anderson et al. | 175/304 |
| 4,186,807 | 2/1980 | Sutliff et al. | 175/302 |
| 4,270,620 | 6/1981 | Lawrence | 175/322 |
| 4,298,078 | 11/1981 | Lawrence | 175/72 |
| 4,376,468 | 3/1983 | Clark | 175/304 |
| 4,526,241 | 7/1985 | Anders | 175/76 |
| 4,665,998 | 5/1987 | Burton | 175/299 |
| 4,688,649 | 8/1987 | Buck | 175/299 |

*Primary Examiner*—David J. Bagnell

*Attorney, Agent, or Firm*—Vaden, Eickenroht & Thompson, L.L.P.

[57] ABSTRACT

A rotary jar is described that is part of a drill string and includes a mandrel and an anvil that move longitudinally in opposite directions to deliver a sharp upward or downward blow that is transmitted to a fish, which may be a separate tool or a portion of the drill string that is stuck in the well bore in an effort to free the fish or the stuck portion of the drill pipe. The mandrel carries rollers that move through longitudinally extending grooves when the jars are tripped. In the jars of this invention, the grooves follow a serpentine path to cause the mandrel to transmit a torsional force on the fish to try to rotate the fish as well as providing an upward or downward blow.

5 Claims, 3 Drawing Sheets

FIG. 1
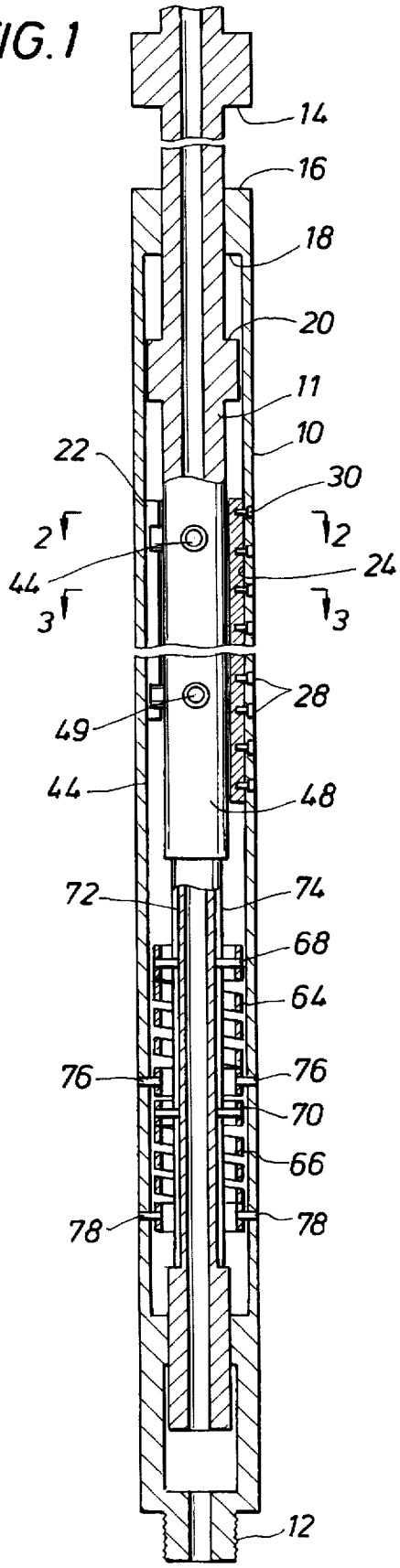
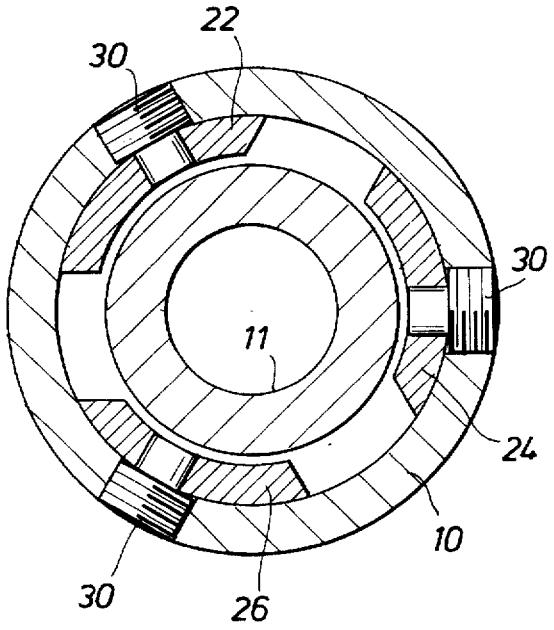
FIG. 2
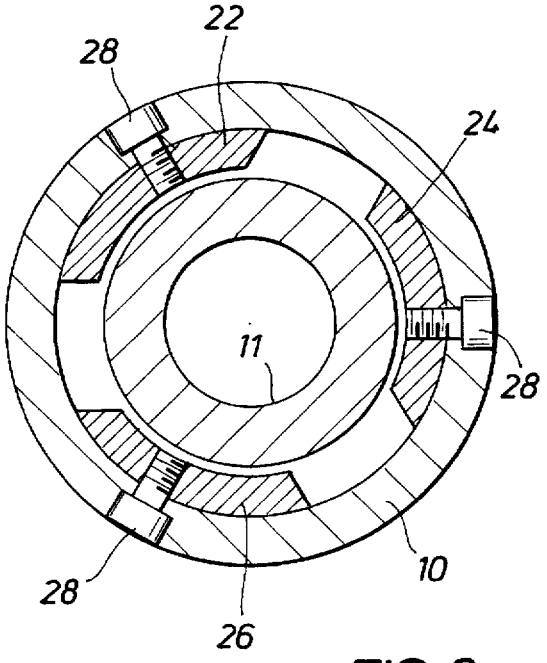
FIG. 3

FIG. 4
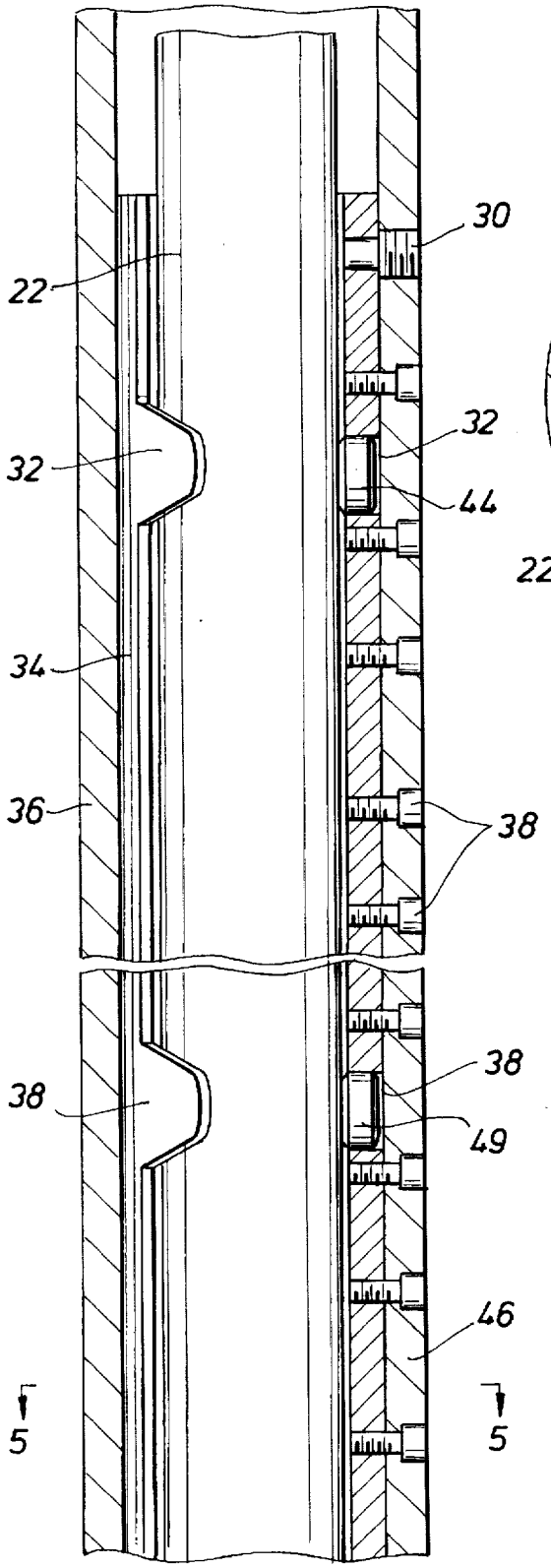
FIG. 5
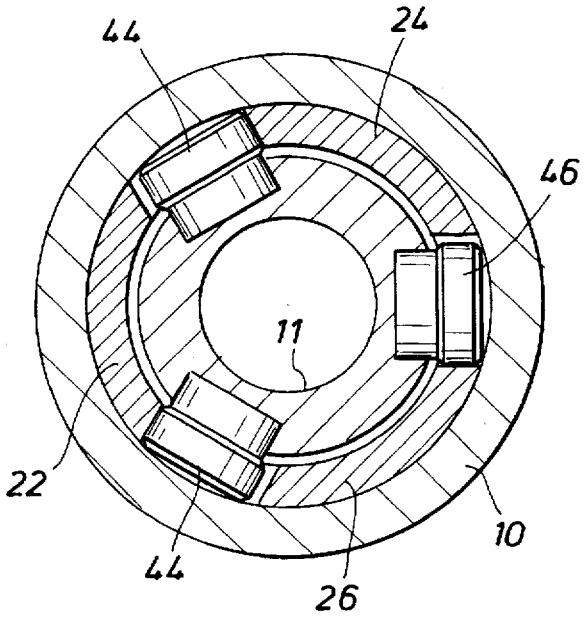
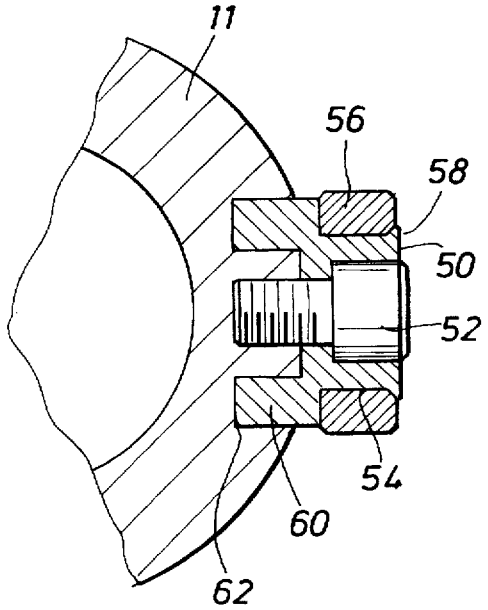
FIG. 6

ROTARY JAR

BACKGROUND OF THE INVENTION

This invention relates to well jars generally and in particular to rotary jars that allow the force required to trip the jars to be changed by changing the torque in the jars.

Well jars are part of the drill string. Their purpose is to strike a sharp blow upwardly or downwardly on the drill string as the drill string exerts an upward or downward force on the portion of the string below the jars that is stuck in the hole. Obviously, if the pipe string is stuck above the jars, they cannot help free the pipe.

One of the most common causes of "Stuck Pipe" is differential pressure sticking. This condition occurs when the hydrostatic head pressure of the mud column exceeds the pressure in a formation that has been penetrated by the well bore. This differential pressure can hold the pipe string against the formation on one side of the well bore with a force great enough to prevent longitudinal and rotational movement of the pipe relative to the formation. Another common cause of stuck pipe are "key seats". These are formed when the inclination of the well bore increases over a relatively short distance, which can result in the drill string being pulled into engagement with the high side of the well bore.

A drill string includes a "bottom hole assembly", which consists of the bit and whatever number of drill collars and joints of heavyweight drill pipe that are considered necessary to put weight on the bit. Rotary jars are normally run at the top of the bottom hole assembly since the large diameter drill collars and drill pipe are most likely to stick. When the drilling assembly becomes stuck, the driller uses the jars to apply sharp upward and downward forces to the assembly to help free it. Jars are normally set to trip when an upward force is exerted on the jars that is about 20,000 to 30,000 pounds more than the weight of the drill pipe above the jars or a downward force of about 20,000 to 30,000 pounds is exerted on the jars using the weight of the drill pipe.

In recent years, the practice of running 18 to 27 thirty foot drill collars has changed to a combination of a few collars and several joints of heavyweight drill pipe. This practice is especially prevalent in highly deviated well bores where drill pipe sticking is most likely to occur. Under the former practice, drilling jars were run just above the top drill collar and always in the neutral tension/compression position to protect the jars from excessive compressive or tensile stress. With the advent of heavyweight drill pipe, it is still necessary to run the jars in the neutral position, therefore, jar placement is normally above the last joint of heavyweight pipe.

Common practice is to run 900 to 1,500 feet of heavyweight pipe above one stand (three 30') drill collars. Under these conditions, using three 8" drill collars, 1,500 feet of five inch heavyweight pipe and 20,000 pounds of over pull the heavyweight pipe will stretch 3" at the jars and 10,000 feet of 5" drill pipe will stretch 55 inches at the rig floor. As the jars trip (release all weight beneath the jars) the mandrel is pulled upwardly at a high velocity because of the potential energy stored in the stretched drill pipe. The heavyweight pipe also has stored potential energy due to the three inches of stretch and accelerates downward rapidly. The jar mandrel accelerating upwardly strikes the jar anvil, which will be accelerating downwardly, causing a sharp upward blow to be delivered to the stuck portion of the pipe—the fish. However, since the mandrel and the anvil impact while they are accelerating in opposite directions, the force that will be transmitted to the fish will be the difference between the upward force of the mandrel and the downward force of the anvil.

The jars of this invention operate on the principle described in U.S. Pat. No. 3,208,541, U.S. Pat. No. 3,233,690, and U.S. Pat. No. 4,665,998, all of which are incorporated herein by reference.

Basically, the jars described in the patents and the jar of this invention include two telescoping members, an inner member (the mandrel) and an outer member (the anvil). In the jars described in the '541 and '690 patents, the mandrel is provided with a plurality of notches that have curved outwardly flaring sidewalls and longitudinally extending grooves. A plurality of rollers are mounted on the inside of the anvil for moving into and out of the notches and the grooves. When the rollers are in the notches, the two telescoping members cannot move longitudinally relative to each other. When the rollers are in the grooves, the two members can move longitudinally relative to each other. Their movement longitudinally is limited by impact shoulders and it is through the shoulders that the potential energy stored in the drill pipe is transmitted to the stuck drill string during the operation of the jar.

In the '998 patent, the grooves are on the inside wall of the anvil and the rollers are mounted on the mandrel. This is the arrangement shown and described in this specification.

To allow the build up of energy in the drill pipe, the rollers are held in the notches by a spring. When the longitudinal force on the jars has a horizontal force component due to the flared sidewalls of the notches that is large enough to rotate the two members relative to each other and force the rollers out of the notches, the jar trips and the two members move relative to each other with great velocity until the impact shoulders on the members meet. The impact of the shoulders meeting produces a sharp blow on the drill string. The amount of energy transmitted to the drill string depends upon the potential energy stored in the drill string as the jar is tripped. The amount of longitudinal force required to trip the jar depends upon the spring force resisting the lateral movement of the rollers and the angle that the sides of the notches make with the horizontal, which determine the horizontal component produced by a given longitudinal force. The upward or downward force required to trip the jars can be adjusted by applying torque to the drill string. Torque in one direction will assist the spring and require a greater force to trip the jars. Torque in the opposite direction will decrease the force required.

It is the object of this invention to improve upon a rotary jar of the type described above by providing serpentine (sine wave) shaped grooves in the mandrel through which the rollers travel when the jar is tripped to transmit torque to the fish (the stuck section of the drill string) urging the fish to rotate clockwise and then counterclockwise to assist in breaking the seal between the fish and the well bore in the case of differential pressure sticking.

It is yet another feature of this invention to convert the potential energy in the drill string at the time the jars are tripped into a torsional force that reverses direction urging the fish to rotate back and forth.

As the rollers move upwardly along the sine wave grooves, they will also move laterally first counterclockwise and then clockwise and a huge angular acceleration will be imparted to both the upper and lower drill strings. As this is real motion involving a large mass, large angular momentum is imparted to these members. Contrary to a conventional jar where the kinetic energy of the mandrel is dissipated in a fraction of a second, the angular momentum will occur over a significant period of time and will traverse both upper and lower sections of the drill string at a high speed. The rotational motion will be damped as the wave progresses away from the jars, but the magnitude of the degree of rotation and the time in which it occurs is a function of the frequency and amplitude of the sine wave grooves. These are controllable variables machined into the design. There is a large surplus of available potential energy in the stretched drill string which is mostly wasted in conventional jars due to the nullifying effect of the downward acceleration of the drill string beneath the jars, and the fact that conventional jars only impart linear motion. By converting a large portion of the available potential energy stored in the stretched drill string to torque thereby rotating the lower and upper sections the jars ability to break the seal between the fish and the wall cake, thereby equalizing the pressure around the fish and freeing the pipe, is greatly increased. This is especially important when trying to free drill pipe in high angle holes.

The rotational motion produced by the serpentine grooves is transmitted to the drill string above the jars as well and this torque initially is in the direction to break the threaded connections between the drill pipe.

Therefore, it is another object and feature of this invention to provide a torque dissipating sub assembly for connecting in the drill string above the mandrel to prevent rotational motion from being transmitted tot he tool joints above the jars in the drill string. The sub assembly can reduce or eliminate the rotational motion by using mechanical means to convert the kinetic energy to either thermal energy through friction or to potential energy through a resistive spring force. The continued application of torque to the fish as the jar is tripped over and over should increase the chances of freeing the fish.

These and other objects, advantages, and features of the invention will be apparent to those skilled in the art from reading this specification including the attached drawings and appended claims.

IN THE DRAWINGS

FIG. 1 is a vertical, sectional view through the preferred embodiment of the well jar of this invention.

FIG. 2 is a sectional view taken along line 2—2 of FIG. 1.

FIG. 3 is a sectional view taken along line 3—3 of FIG. 1.

FIG. 4 is a vertical, sectional view on an enlarged scale of the portion of the jar in FIG. 1 where the cam plates and rollers are located.

FIG. 5 is a view taken along line 5—5 of FIG. 4.

FIG. 6 is a cross-sectional view through one of the roller assemblies attached to the inner member of the jar.

Figure 8:
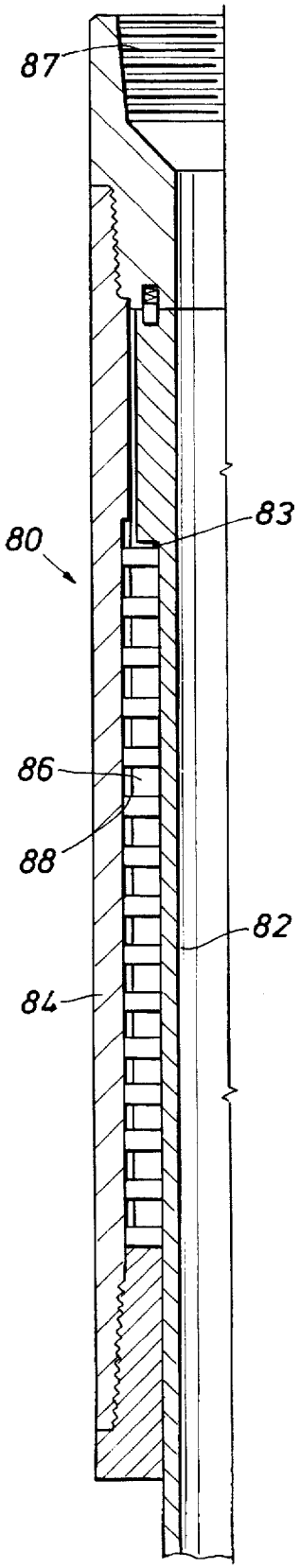
FIG. 8 is a sectional view of a torque dissipating sub assembly which can be used to prevent the transmission of torque to the still string above the jar.
Figure 8A:
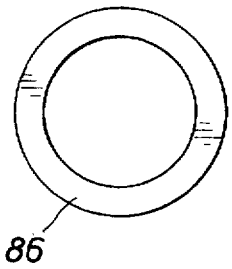
Figure 8B:
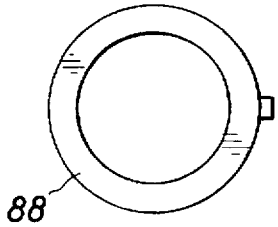

FIGS. 8A and 8B, respectively, are end views of a clutch disc and a clutch plate used in the torque dissipating sub of FIG. 8.

Figure 9:
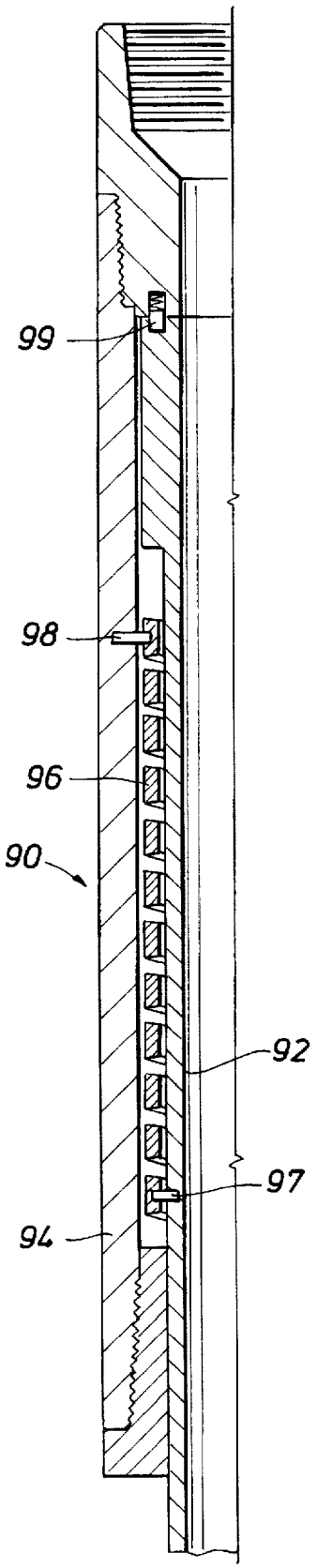

FIG. 9 is a sectional view of an alternative torque dissipating sub assembly which can be used to prevent the transmission of torque to the drill string above the jar.

The jar includes outer member 10 (the anvil) and inner member 11 (the mandrel) that are movable longitudinally relative to each other a limited distance. In FIG. 1, these tubular members are shown in one piece whereas they are actually made up of a number of tubular sections connected together by threads for ease of machining assembly and repair or replacement of worn or broken parts of the jar. Mandrel 11 is provided with appropriate threads (not shown) for connecting the mandrel to the drill string extending between the jar and the surface. Anvil 10 has threads 12 on its lower end for connecting the anvil to the fishing tool or the portion of the drill string extending below the jar. This is the usual arrangement. The roles of the two members could be reversed, if desired.

The distance the members can move longitudinally relative to each other is limited by annular shoulders on the members. When the jar is in use, the anvil will be connected to the stuck pipe and will move only as far as the pipe between the jar and the fish is stretched. Therefore, it is the mandrel that moves relative to the anvil during a jarring operation. As the mandrel moves downwardly, its travel is limited by the engagement of downwardly facing shoulder 14 on the mandrel and upwardly facing shoulder 16 on the anvil. Upward movement is limited by downwardly facing shoulder 18 on the anvil and upwardly facing shoulder 20 on the mandrel. In operation, as explained above, these shoulders come together with great force due to the energy stored in the drill pipe before the jar is tripped.

In this embodiment, the jar can jar both up and down. Holding means are provided to hold the mandrel and anvil from relative movement while energy is being stored in the drill string. In the embodiment shown, the holding means includes three cam plates 22, 24, and 26 that are laterally spaced around the inner surface of the anvil. As shown in FIGS. 2 and 3, they are arcuate in cross-section to fit the curvature of the inner surface. The cam plates are held in position by a plurality of cap screws 28 that extend through openings provided in the wall of the anvil to engage tapped holes in the cam plates. To position the cam plates to receive the cap screws, locator pins 30, are positioned in openings in the sidewall of the anvil 10 to engage a non-tapped locating hole at the upper end of each cam plate. These pins align the tapped holes in the plates with the openings in the sidewall of the anvil to insure that the cam plates are properly positioned relative to each other on the inside wall of the anvil. These locator pins are shown in FIG. 2.

Each cam plate has a plurality of U-shaped notches, as best seen in FIG. 4 where the mandrel is broken away to show cam plate 22 in elevation. In this embodiment, two longitudinally spaced sets of three notches each are used. The upper set is made up of notches 32. The lower set is made up of notches 38. The notches open outwardly in a lateral direction with diverging curved sidewalls.

Figure 7:
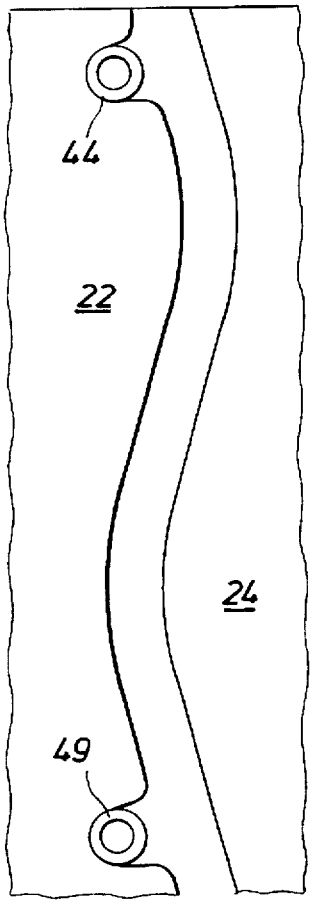
FIG. 7 is a plan view of the grooves through which the rollers travel when the jar is tripped.

A plurality of rollers are located on the outer surface of the mandrel to engage the notches and hold the mandrel from longitudinal movement relative to the anvil. When the rollers are out of engagement with the notches and positioned in the longitudinal extending spaces between the cam plates, as shown in FIG. 5, where upper rollers 44 and lower rollers 49, (only one of which is shown in FIG. 7) are positioned in between cam plates 22, 24, and 26, the mandrel can move longitudinally relative to the anvil. The rollers are attached to the outer surface of the mandrel in two spaced groups of three. They are spaced vertically as shown in FIG. 4 so the rollers in one group engage upper notches 32 and the other group of rollers engage lower notches 38.

The two groups of rollers are spaced longitudinally and the spaces between the cam plates through which they travel are designed for the rollers of each group to be longitudinally in alignment with the longitudinal axis of the jar as they move through the spaces between the plates.

A typical roller assembly is shown in FIG. 6. It includes shaft 50 and cap screw 52 that attaches the roller assembly to mandrel 11. Shaft 50 has cylindrical surface 54 upon which roller 56 is mounted for rotation relative to shaft 50. To assemble the roller on the shaft, cylindrical surface 54 extends outwardly to the end of the shaft. The roller is moved into position over the cylindrical surface and then the end of the shaft is upset to form retaining ring 58 to hold the roller on the shaft while allowing the roller to freely rotate relative to the shaft.

In order to relieve cap screw 52 of as much of the stress imposed on shaft 50 by roller 56, the inner end of shaft 50 is cup-shaped to provide annular section 60 that extends into annular recess 62 in the sidewall of inner member 11. By designing annular section 60 of the shaft so that there is little clearance between the walls of the annular section and the walls of the recess, a portion of the reaction forces required to resist the load imposed on the shaft by the roller are transmitted directly to the mandrel through annular section 60.

To hold the rollers in engagement with the notches, two torsion springs 64 and 66 are positioned at the lower end of the jar. The upper end of each spring is connected to the mandrel through pins 68 and 70. These pins engage keyways 72 and 74 that extend along the outer surface of the mandrel so that the spring can exert a torque on the mandrel but still allow relative movement of the mandrel relative to the springs. The lower end of each spring is connected to the anvil through pins 76 and 78.

Torque is imposed on the mandrel by rotating the mandrel relative to the anvil a desired distance and then inserting the pins. The torque constantly urges the mandrel to rotate in a direction to move the rollers into the notches. The amount of torque imposed on the mandrel determines at what upward or downward force the jar will trip. Also entering into the determination of when the jar will trip is the angle of the top and bottom sides of the notches. They do not have to be the same. The notches could be arranged to trip at a lesser force on a down jar then on an up jar, if desired.

As explained above, it is a feature of this invention that the longitudinally extending spaces between cam plates 22, 24, and 26 are sinusoidal as shown in FIG. 7 where the sinusoidal space between plates 22 and 24 is shown. This causes the rollers to impose torque on the fish, first in one direction and then the other direction as the rollers travel along the spaces between the cam plates. If this torque causes the fish to rotate, it should help in freeing the fish.

It is important that the torque imposed on the drill string below the jar rotate the string in a direction to make up the tool joints in the string. This results, however, it the torque on the drill string above the jar tending to unscrew the tool joints. Thereby, torque dissipating assembly 80 is placed in the string immediately above the drilling jar.

Torque dissipation assembly 80 of FIG. 8 includes inner tubular member 82 that is connected to the jar mandrel and outer sleeve 84 that is connected to the drill string above the jars by tool joint 87. The inside diameter of a portion of tubular member 82 is reduced to forum annular cavity 83 between member 82 and sleeve 84. A plurality of clutch disks 86 and clutch plates 88 are positioned alternately in annular cavity 83. The clutch plates and the clutch disks are compressed around member 82 to prevent relative rotation of the member and the sleeve. The clutch disks and plates are compressed with sufficient force to hold member 82 and outer sleeve 84 in fixed arrangement without slippage during normal drilling operations. However, when the drilling jar is tripped, the torque generated by the jar exceeds the compression force of the clutch disks and plates and the inner member rotates relative to the outer sleeve. This slippage allows the torsional energy of the jar to be converted to thermal energy as friction occurs between the clutch and the inner tubular member 82. Further, spring loaded pin 88 provides a positive means of providing rotation of the drill string should the clutch disks and plates become so worn that they are no longer able hold member and sleeve 84 in fixed arrangement.

FIG. 9 shows alternative torque dissipation assembly 90 which includes resilient means, preferably torsional spring 96, for absorbing the upward torsional energy generated by the jar. Assembly 90 comprises inner and outer tubular members 92 and 94. The lower end of torsional spring 96 is connected to inner tubular member 92 by pin 97 while the upper end is connected to outer tubular member 94 by pin 98. During normal drilling operations right hand torque causes the inside diameter of spring 96 to decrease and grip tubular member 92 with sufficient force to transmit torque to this drill string below. When torque is transmitted upward from the jar, spring 96 moves out of frictional engagement with tubular member 92 allowing rotation relative to tubular member 94, absorbing the rotational energy and converting it to potential energy. This potential energy is then converted back to rotational motion as the spring imposes an oppositely directed torque on the mandrel of the drilling jar. Should spring 96 break or become separated from either the inner or outer tubular member, assembly 90 is provided with spring loaded pin 99 which limits the free relative rotation of the tubular members to 350°.

The above described torque dissipating assemblies are particularly useful for use with jars that generate torque in a single direction unlike the jar described above. The jar described above imposes torque alternately between a clockwise direction and counterclockwise direction due to the sinusoidal nature of the longitudinally extending spaces between the cam plates of the jar. It is anticipated that these complementary forces will tend to eliminate any tendency to back off the threaded connections in the string.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed:

1. In a rotary jar for connecting in a pipe string to produce a sharp upward or downward force on the pipe string when the pipe string becomes stuck in a well bore said jar comprising, an inner tubular mandrel member and an outer tubular anvil member for connecting in a pipe string for limited longitudinal movement relative to each other, impact shoulders on the members limit the relative longitudinal movement of the members, a plurality of laterally spaced rollers attached to the outer surface of the mandrel, longitudinally extending grooves on the inner surface of the anvil, each groove intersecting a U-shaped laterally extending notch formed with curved outwardly flaring walls on the inner surface of the mandrel, and resilient means urging the tubular members to rotate relative to each other in the direction to move the rollers into the U-shaped notches and to allow the roller means to move out of the U-shaped notches when a longitudinal force is imposed on the jar sufficient for the flared walls of the U-shaped notches to provide a lateral component of force on the rollers that will overcome the force of the resilient means and move the rollers out of the U-shaped notches into the longitudinally extending grooves allowing the mandrel to move longitudinally relative to the anvil until the impact shoulders engage and produce a sharp increase in the force exerted by the string when the string is stuck in the hole, the improvement comprising longitudinally extending serpentine grooves that convert a portion of the relative longitudinal motion of the mandrel and the anvil into angular motion tending to rotate the anvil back and forth relative to the mandrel.

2. The jar of claim 1 in which said serpentine groove is sinusoidal.

3. The jar of claim 1 in which said resilient means are a plurality of longitudinally spaced torque springs connecting the inner and outer tubular members.

4. The jar of claim 1 further including, a torque dissipating sub for connecting to the upper end of the mandrel to prevent the left hand torque imposed on the mandrel from being transmitted to tool joints above the jars said torque dissipating subcomprising inner and outer tubular members, means for connecting the inner tubular member of the assembly to the mandrel of the jar, means for connecting the outer tubular member to the pipe string, an annular cavity between the inner and outer members, and clutch plates positioned in the cavity to prevent relative right hand rotation between the inner and outer tubular members to thereby transmit right hand torque to the jars and the pipe string below the jars sub and the mandrel and allowing left hand rotation of the inner tubular member relative to the outer tubular member to prevent left hand torque from being transmitted to the tool joint above the sub.

5. The jar of claim 1 further comprising a torque dissipating sub for attaching in the pipe string above the jar and to the mandrel of the jar, said assembly having inner and outer tubular members rotationally movable relative to each other, means for connecting the inner tubular member of the assembly to the mandrel of the jar, means for connecting the anvil to the pipe string, a coil spring encircling the inner member having one end connected to the inner surface of the outer tubular member and the other end connected to the outer surface of the inner tubular member of the assembly to prevent relative right hand rotation between the pipe string and the jars while allowing limited left hand rotation of the pipe string.

* * * * *

UNITED STATES PATENT AND TRADEMARK OFFICE

CERTIFICATE OF CORRECTION

PATENT NO. : 5,669,458

DATED : September 23, 1997

INVENTOR(S) : Edward O. Anders

It is certified that error appears in the above-indentified patent and that said Letters Patent is hereby corrected as shown below:

Col. 3, line 27, change "tot he" to --to the--.
Col. 3, line 59, change "still" to --drill--.
Col. 5, line 43, change "then" to --than--.
Col. 5, line 54, change "it" to --in--.
Col. 5, line 56, change "Thereby" to --Therefore--.
Col. 5, line 62, change "forum" to --form--.
Col. 6, line 12, after "able" insert --to--.
Col. 6, line 12, after "member" insert --82--.
Col. 8, line 3, change "subcomprising" to --sub comprising--.
Col. 8, line 11, cancel "jars".

Signed and Sealed this

Seventeenth Day of February, 1998

*Attest:*

*Attesting Officer*

BRUCE LEHMAN

*Commissioner of Patents and Trademarks*